US006202854B1

(12) United States Patent
Krieser et al.

(10) Patent No.: US 6,202,854 B1
(45) Date of Patent: Mar. 20, 2001

(54) AIR CLASSIFIER FOR PARTICULATE MATERIAL

(75) Inventors: Clarence Krieser, Richland; James Miller, Lebanon, both of PA (US)

(73) Assignee: Marsulex Environmental Technologies, LLC, Lebanon, PA (US)

( * ) Notice: Subject to any disclaimer, the term of this patent is extended or adjusted under 35 U.S.C. 154(b) by 0 days.

(21) Appl. No.: 09/273,641

(22) Filed: Mar. 23, 1999

(51) Int. Cl.[7] ..... B07B 4/00
(52) U.S. Cl. ..... 209/135; 209/143; 209/149
(58) Field of Search ..... 209/133, 134, 209/135, 136, 137, 142, 143, 146, 147, 149

(56) References Cited

U.S. PATENT DOCUMENTS

| | | | | |
|---|---|---|---|---|
| 4,038,178 | | 7/1977 | Hukki | 209/161 |
| 4,055,487 | | 10/1977 | Moori | 209/44 |
| 4,151,074 | | 4/1979 | Mohri | 209/44 |
| 4,252,642 | | 2/1981 | Mohri | 209/452 |
| 4,307,242 | | 12/1981 | Shah et al. | 556/472 |
| 4,885,832 | * | 12/1989 | English | 209/135 X |
| 5,024,754 | * | 6/1991 | Patzelt et al. | 209/135 |
| 5,511,668 | * | 4/1996 | Keuschnigg | 209/135 |

FOREIGN PATENT DOCUMENTS

3730382 * 3/1989 (DE) ..... 209/135

OTHER PUBLICATIONS

P.W. Atkins, *Physical Chemistry*, Third Edition (1986), pp. 770–772, 784–785.

* cited by examiner

*Primary Examiner*—Tuan N. Nguyen

(57) ABSTRACT

An apparatus and process for removing fine particles from sand and other particulate material. The apparatus is generally an air classifier (10) that combines gravitational and aerodynamic forces to classify sand at 10 mesh and finer. According to this invention, the classifier (10) is configured to have a vertical passage (16) centrally located at the vertical axis of an annular-shaped passage (12). The vertical passage (16) is defined by a plurality of inclined vanes (20) that are vertically separated by gaps (28). The sand or other particulate matter is introduced through an inlet (18) at or near the top of the annular-shaped passage (12), and then flows downwardly through the annular-shaped passage (12) around the vertical passage (16). Air is flowed substantially horizontally into the annular-shaped passage (12) and radially inward toward the vertical passage (16) and the vanes (20) thereof so that, as the particulate matter flows downwardly through the annular-shaped passage (12), the air separates a relatively finer constituent of the particulate matter from a relatively coarser constituent of the particulate matter.

20 Claims, 2 Drawing Sheets

AIR CLASSIFIER FOR PARTICULATE MATERIAL

BACKGROUND OF THE INVENTION

1. Field of the Invention

This invention generally relates to classifiers used for separating relatively fine particles from a particulate material, such as sand used in the road construction industry. More particularly, this invention is directed to an air classifier having a compact construction with reduced energy requirements.

2. Description of the Prior Art

Sand used in the construction of asphalt and concrete roads is sized to provide an appropriate particle size distribution which excludes extremely fine particles (dust) that are undesirable for the final asphalt or concrete mix. Removal of the fine particles is often performed after the sand has been processed through a crusher and then sized. Typical methods for removing fine particles from sand and other particulate matter include placing the sand on a wash screen, and then flowing water over the screen to carry finer particles, e.g., −200 mesh (less than 75 $\mu$m) through the screen. The resulting sand slurry is then pumped to a settling pond. The sand remaining on the screen typically has a moisture content of about 8%, and therefore requires drying before being added to an aggregate mixture for use in the production of asphalt or concrete.

Though widely used, wet screening processes have several disadvantages. The use of water can pose a problem if the construction site is in an arid area, and the necessity to dry the processed sand adds undesirable equipment and fuel costs. The environmental impact of settling ponds is also undesirable. Therefore, what is needed is a process and apparatus for removing fine particles from sand that is suitable for use in such applications as asphalt and concrete road construction. In addition to eliminating the requirement for water, a suitable apparatus would also preferably have minimal energy requirements and provide a compact operating unit for ease of transportation.

SUMMARY OF THE INVENTION

The present invention provides an apparatus and process for removing fine particles from sand and other particulate material. The apparatus is generally an air classifier that combines gravitational and aerodynamic forces to classify sand at 10 mesh and finer. According to this invention, the classifier is configured to have a vertical passage centrally located at the vertical axis of an annular-shaped passage. The vertical passage is defined by a plurality of inclined vanes that are vertically separated by gaps. The sand or other particulate matter to be sized is introduced through an inlet at or near the top of the annular-shaped passage, and then flows downwardly through the annular-shaped passage around the vertical passage. Air is flowed substantially horizontally into the annular-shaped passage and radially inward toward the vertical passage and the vanes thereof so that, as the particulate matter flows downwardly through the annular-shaped passage, the air separates a relatively finer constituent of the particulate matter from a relatively coarser constituent of the particulate matter. More specifically, the airflow is regulated so that the coarser constituent is allowed to continue to flow downward out of the annular-shaped passage, but at least a portion of the air causes the finer constituent of the particulate matter to flow upwardly through the gaps between the vanes into the vertical passage, and then downwardly through the vertical passage and eventually out of the vertical passage. Thereafter, the finer constituent can undergo any further separation processing, such as with cyclones and/or fabric filter collectors.

According to the above, the efficiency of the process of this invention is promoted as a result of air being introduced into the annular-shaped passage from essentially the entire perimeter of the passage, and flowed radially inward toward the vertical passage. With this arrangement, a relatively large area is provided for processing the sand for a given vertical drop of the sand. Another advantage is a relatively low energy requirement for expelling the finer constituent from the classifier, which is achieved because the finer particles are immediately redirected downward through the classifier after passage through the vanes, such that their flow out of the classifier is assisted by gravity. Additional benefits of the invention are derived from eliminating the prior art use of water, which may not be available at the processing location, would necessitate the use of a settling pond, and yields an aggregate that requires drying. Finally, the classifier is able to remove dust and other fine constituents of a particulate matter immediately downstream from a crusher, without any intervening sizing operation of a type conventionally required by the prior art. As a result, particulate emissions are reduced and subsequent sizing and dust suppression is simplified.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 1:
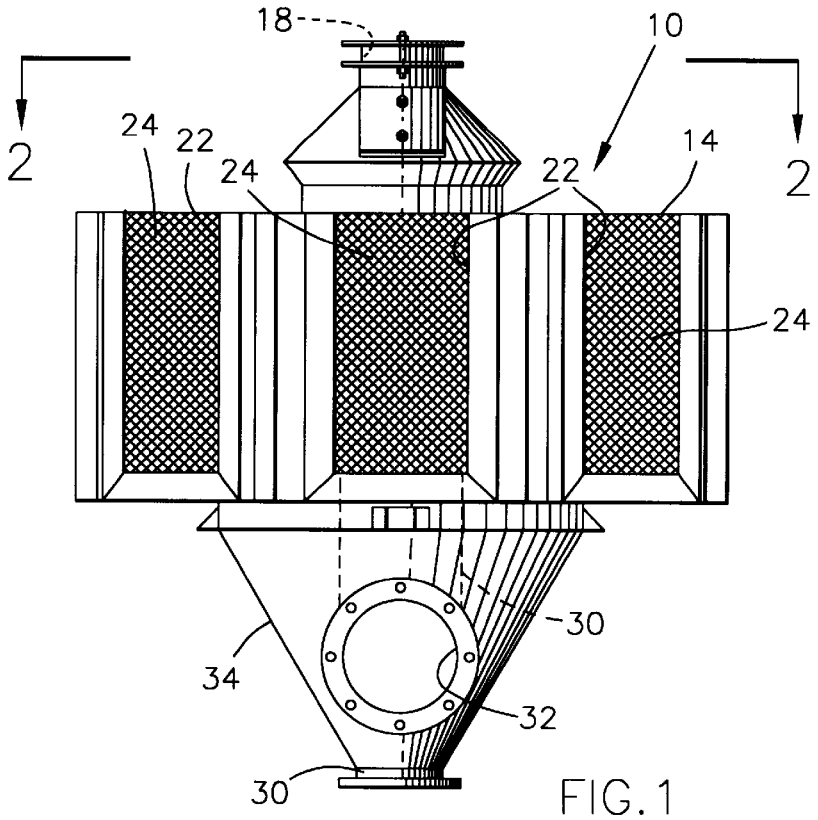
FIGS. 1, 2 and 3 are side, plan and cross-sectional views, respectively, of an air classifier in accordance with a preferred embodiment of this invention.
Figure 2:
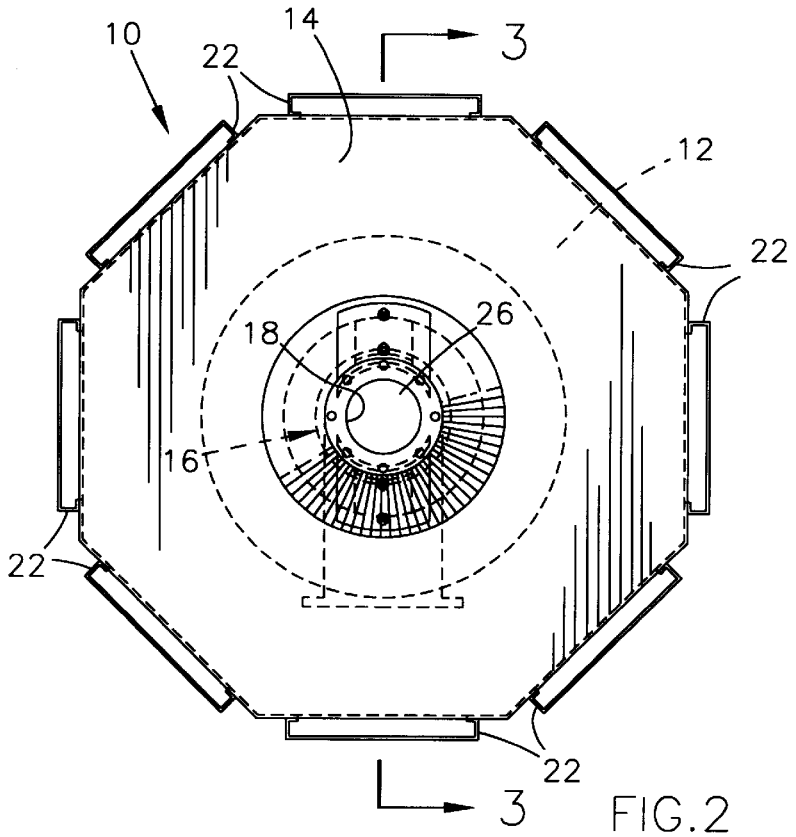
Figure 3:
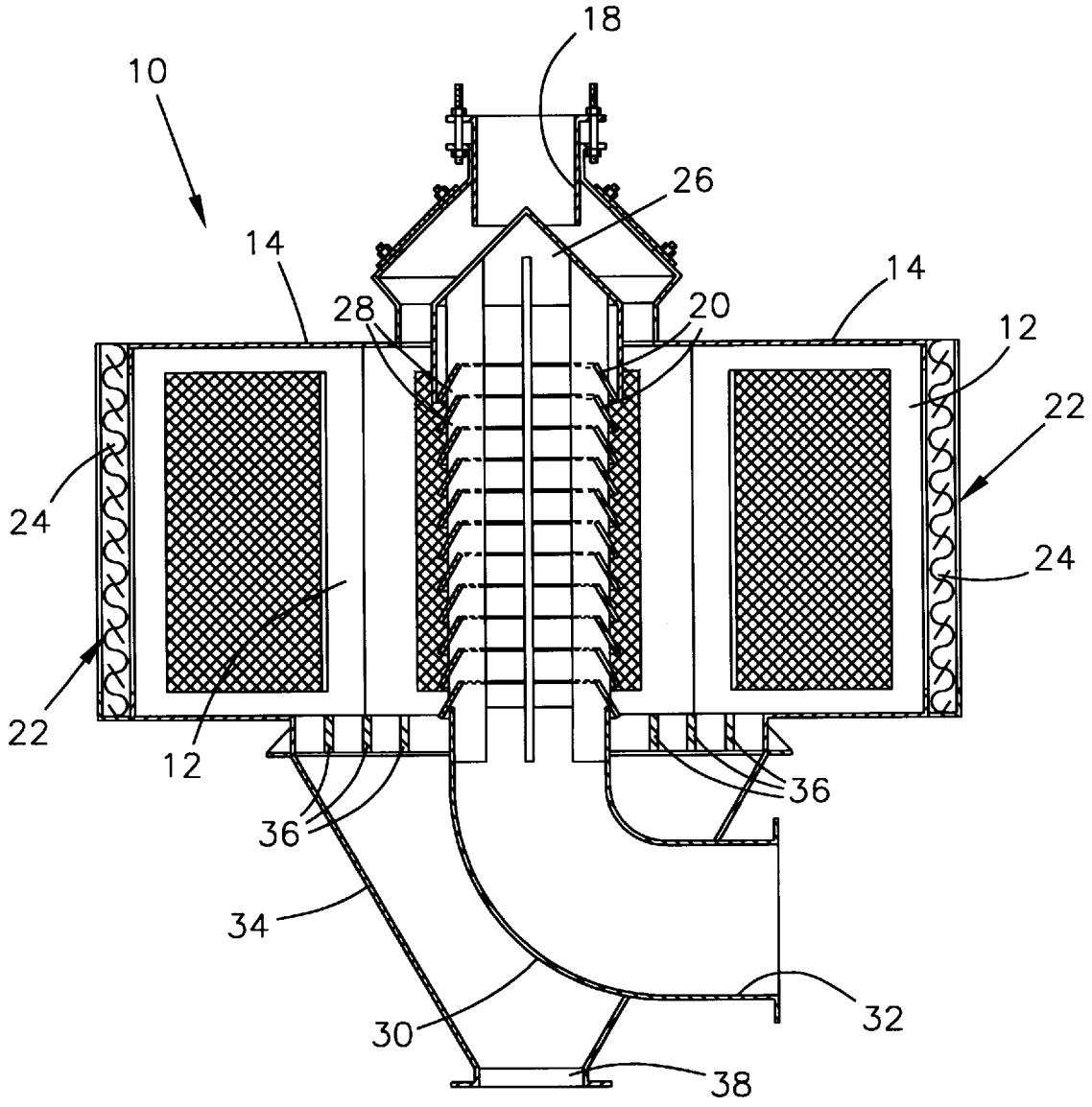

An air classifier 10 in accordance with a preferred embodiment of this invention is shown in FIGS. 1 through 3. The classifier 10 is configured to remove fine particles from a quantity of particulate feed material, such as sand, flowing downwardly through an annular-shaped cavity 12 formed by an exterior enclosure 14 and a vertical passage 16 within the enclosure 14. An inlet 18 to the cavity 12 is located at the top of the enclosure 14 so that feed material entering the cavity 12 flows down around the vertical passage 16, which is formed by a number of horizontal vanes 20. The enclosure 14 generally has an octagonal exterior shape as seen in FIG. 2, though other geometric shapes are foreseeable. Air inlets 22 are located along the entire perimeter of the enclosure 14, so that air from a suitable source (not shown) flows substantially horizontally into the cavity 12, and radially inward toward the passage 16 and its vanes 20. Filters 24 are preferably mounted in the inlets 22 to exclude dust and other fine matter from the cavity 12. While eight air inlets 22 are shown, air could be introduced through any number of inlets as long as an adequate and uniform air flow toward the vanes 20 can be maintained.

As seen in FIG. 3, the vanes 20 account for the majority of the length of the vertical passage 16 within the enclosure 14. The upper end 26 of the passage 16 near the inlet 18 is closed and preferably tapered as shown to promote the uniform flow of feed material around the passage 16. The vanes 20 are axially and vertically arranged relative to each other, and each vane 20 is preferably continuous around the entire perimeter of the passage 16. The vanes 20 are inclined so that their top edges are closer to the vertical axis of the passage 16 than their lower edges. As a result, and as seen in FIG. 3, the top edge of each vane is radially inward from the lower edge of the vane 20 immediately above, creating a frustroconical gap 28 therebetween. The upper and lower edges of immediately adjacent vanes 20 also preferably overlap each other in the axial direction, so that air flowing horizontally and radially inward through the annular-shaped cavity 12 cannot flow horizontally into the passage 16, but instead is deflected upward into the passage 16 by the vanes 20. A suitable inclination angle for the vanes 20 is about 30 degrees relative to the vertical axis of the passage 16, and a suitable width for each gap 28 is about two centimeters when measured in a direction perpendicular to the vanes 20. However, it is foreseeable that the vane inclination and gap could differ from the values noted here and still achieve suitable results.

The lower end of the vertical passage 16 is open and connects with an arcuate-shaped pipe 30 whose outlet 32 is oriented radially outward relative to the vertical axis of the passage 16. As will be explained in more detail below, the finer particles of the feed material flowing through the classifier 10 are discharged through the outlet 32. The pipe 30 is partially enclosed within a tapered outlet chamber 34 attached to the lower end of the enclosure 14, with the outlet 32 projecting outward through the wall of the chamber 34. Concentric rings 36 are shown located between the annular-shaped cavity 12 and the outlet chamber 34 to promote the uniform flow of feed material into the chamber 34. An outlet 38 is located at the lower end of the chamber 34, through which the coarser particles of the feed material exit the classifier 10.

In operation, feed material from any suitable source, such as a crusher, is introduced into the annular-shaped cavity 12 at a rate which preferably yields a continuous feed curtain that completely surrounds the vertical passage 16 and its vanes 20. The feed curtain is preferably within about ten millimeters of the vanes 20. The classifier 10 may not function properly if the feed curtain is deflected too far from the vertical passage 16 by the tapered upper end 26 of the passage 16. Air enters the classifier 10 through the inlets 22 and flows horizontally and radially inward toward the passage 16. Suitable air flow velocities are generally in the range of about fifteen to thirty feet per second (about 4.6 to about 9.1 m/s). The air impinges the continuous feed curtain that is falling in front of the passage 16. The angle of impingement is roughly ninety degrees as a result of the feed material falling vertically and the air flow being horizontal. A majority of the air passes through the feed material, and is then immediately deflected upward into the vertical passage 16 by the vanes 20, generally in the opposite direction of the flow of the feed material. The finer particles of the feed material are entrained with the deflected air flow, and therefore also flow into the passage 16.

Separation of the finer particles from the feed material is generally the result of gravitational and aerodynamic forces acting on the particles. Each particle entering the classifier 10 is subject to a downward gravitational force proportional to its mass, which in turn is proportional to the cube of the particle diameter. The particle is also subject to a drag force created by the air flow through the feed curtain. This drag force is proportional to the square of the particle diameter and causes each particle to change its flow direction, radially inward toward the vertical passage 16 and its vanes 20. As a result of this change in direction of movement, each particle is also subjected to a small centrifugal force that is proportional to the particle mass and opposes the drag force applied by the airflow. Under steady state conditions, the resultant force acting on a particular particle will be of a magnitude and direction such that the particle will either be swept through the gaps 28 between the vanes 20, or will impinge one of the vanes 20, causing the particle to be thrown back into the feed curtain. The particle diameter at which particles are entrained in the air entering the vertical passage 16 is referred to as the cutpoint. The resultant force on a particle larger than the cutpoint is in a direction at small variance with the gravitational force on the particle. As a result, these coarser particles are deflected back into the feed curtain when they impinge a vane 20, or otherwise remain in the feed curtain and fall through the annular-shaped cavity 12 into the outlet chamber 34. The coarser particles are then collected through the outlet 38.

In contrast, the resultant force on a particle at or below the cutpoint is in a direction almost parallel to the drag force, causing such particles to be swept by the air through the vanes 20. Because the upper end 26 of the vertical passage 16 is closed, the air flow through the vanes 20 is immediately redirected as it enters the passage 16, causing the air and the entrained particles to flow downwardly through the passage 16 and eventually out through the pipe 30 and its outlet 32. These relatively fine particles can then be further processed, such as with one or more cyclones and fabric filter collectors that remove dust and other finer particulate matter. Because the fine particles are immediately redirected downward through the classifier 10, as opposed to continuing upward out of the classifier 10, their flow through the classifier 10 is assisted by gravity. As a result, the power requirements for the air source are relatively low.

In practice, the classifier 10 of this invention is able to separate particles having a cutpoint anywhere between 100 and 10 mesh (between about 150 and 1651 micrometers). As would be understood by those skilled in the art, the cutpoint can be controlled by the air velocity through the vanes 20, which determines the magnitude of the drag force on the particles.

While the invention has been described in terms of preferred embodiments, it is apparent that other forms could be adopted by one skilled in the art. For example, the features of this invention could be incorporated within classifier systems that differ from that represented in the Figures, and other and/or additional equipment could be employed to further process the feed material after it leaves the classifier 10. Furthermore, the function of the vanes 20 could be achieved by other structures capable of deflecting the air and entrained fine particles of the feed material upward into the vertical passage 16. Accordingly, the scope of the invention is to be limited only by the following claims.

What is claimed is:

1. An air classifier comprising:

an annular-shaped passage;

a vertical passage centrally located at a vertical axis of the annular-shaped passage;

a plurality of inclined vanes that separate the annular-shaped passage from the vertical passage, the vanes being vertically separated from each other by gaps, each gap being inclined radially inwardly and upwardly toward the vertical passage;

an inlet to the annular-shaped passage, the inlet being configured so that a particulate matter passing therethrough flows downwardly through the annular-shaped passage;

means for flowing air substantially horizontally into the annular-shaped passage and radially inward toward the vertical passage and the vanes, wherein as the particulate matter flows downwardly through the annular-shaped passage, the flowing means causes the air to separate a relatively finer constituent of the particulate matter from a relatively coarser constituent of the particulate matter, the flowing means allowing the coarser constituent to continue to flow downward out of the annular-shaped passage, the flowing means causing at least a portion of the air to flow through the gaps between the vanes the gaps being inclined to cause the finer constituent of the particulate matter to flow radially inwardly and upwardly into the vertical passage and then downwardly through the vertical passage and out of the vertical passage.

2. An air classifier as recited in claim 1, wherein the annular-shaped passage is defined within an enclosure having peripheral walls.

3. An air classifier as recited in claim 1, wherein the vertical passage has a closed upper end adjacent the inlet and an open lower end that projects below the annular-shaped passage.

4. An air classifier as recited in claim 1, wherein the vanes are horizontal and inclined so that each vane has an upper edge that is closer to the vertical axis than a lower edge of the vane, the upper edge of each vane being radially offset from the lower edge of a vane immediately above so as to define the gap therebetween.

5. An air classifier as recited in claim 1, further comprising an outlet passage having a vertical portion interconnected to a lower end of the vertical passage, the outlet passage terminating with a nonvertical portion that directs the finer constituent away from the vertical axis of the annular-shaped passage.

6. An air classifier as recited in claim 1, wherein at least some of the gaps have a frustroconical shape.

7. An air classifier as recited in claim 1, wherein the flowing means and the vanes are configured to cause more air to flow downwardly through the annular-shaped passage than into the vertical passage.

8. An air classifier as recited in claim 1, wherein the flowing means introduces air into the annular-shaped passage uniformly along a periphery thereof.

9. An air classifier comprising:

an enclosure having peripheral walls and a vertical axis;

a vertical passage centrally located at the vertical axis within the enclosure, the vertical passage having a closed upper end within the enclosure and an open lower end that projects below the enclosure, the vertical passage between the closed upper end and the open lower end being defined by a plurality of vanes inclined so that each vane has an upper edge that is closer to the vertical axis than a lower edge of the vane, the upper edge of each vane being radially offset from the lower edge of a vane immediately above so as to define a horizontal gap therebetween;

an annular-shaped passage defined between the enclosure and the vertical passage;

means for introducing air into the annular-shaped passage through the peripheral walls of the enclosure, the introducing means causing the air to flow substantially horizontally and radially inward toward the vanes of the vertical passage;

an inlet above the closed upper end of the vertical passage and configured so that a particulate matter passing therethrough flows downwardly through the annular-shaped passage;

outlet means below the enclosure for receiving particulate matter from the annular-shaped passage; and an outlet passage interconnected to the open lower end of the vertical passage, the outlet passage having a vertical portion within the outlet means and having a nonvertical portion that projects outside the outlet means.

10. An air classifier as recited in claim 9, wherein the vertical passage has a round cross-sectional perimeter and each vane is continuous around the perimeter of the vertical passage.

11. An air classifier as recited in claim 9, wherein the introducing means comprises filters through which the air flows prior to entering the annular-shaped enclosure.

12. An air classifier as recited in claim 9, wherein the closed upper end of the vertical passage is tapered to uniformly distribute the particulate matter in the annular-shaped passage and around the vertical passage.

13. An air classifier as recited in claim 9, wherein the introducing means are uniformly distributed along the peripheral walls of the enclosure.

14. An air classifier as recited in claim 9, wherein the introducing means and the vanes are configured to cause more air to flow downwardly through the annular-shaped passage than into the vertical passage.

15. A method of sizing particulate matter using an air classifier, the method comprising the steps of:

flowing a particulate matter downwardly through an annular-shaped passage that surrounds a vertical passage centrally located at a vertical axis of the annular-shaped passage, the vertical passage and the annular-shaped passage being separated by a plurality of inclined vanes that are vertically separated from each other by gaps, each gap being inclined radially inwardly and upwardly toward the vertical passage; and flowing air substantially horizontally into the annular-shaped passage and radially inward through the particulate matter toward the vertical passage and the vanes, the air separating a relatively finer constituent of the particulate matter from a relatively coarser constituent of the particulate matter, the coarser constituent continuing to flow downward out of the annular-shaped passage, at least a portion of the air flowing through the gaps between the vanes, the gaps being inclined to cause the finer constituent of the particulate matter to flow radially inwardly and upwardly into the vertical passage and then downwardly through the vertical passage and out of the vertical passage.

16. A method as recited in claim 15, wherein the upward flow of the finer constituent within the vertical passage is limited by a closed upper end of the vertical passage, such that the air and the finer constituent entrained therein flows downwardly through the vertical passage.

17. A method as recited in claim 16, wherein the closed upper end of the vertical passage is tapered and uniformly distributes the particulate matter in the annular-shaped passage and around the vertical passage.

18. A method as recited in claim 15, wherein the air is introduced into the annular-shaped passage uniformly along a perimeter thereof.

19. A method as recited in claim 15, further comprising the step of directing the finer constituent away from the vertical axis of the annular-shaped passage after the finer constituent leaves the vertical passage.

20. A method as recited in claim 15, wherein more air flows downwardly through the annular-shaped passage than into the vertical passage.

* * * * *

UNITED STATES PATENT AND TRADEMARK OFFICE

CERTIFICATE OF CORRECTION

PATENT NO. : 6,202,854 B1
DATED : March 20, 2001
INVENTOR(S) : Krieser et al.

It is certified that error appears in the above-identified patent and that said Letters Patent is hereby corrected as shown below:

Title page,
Item [12], "Krieser, et al." should read "Kreiser, et al."
Item [75], "Clarence Krieser" should read "Clarence Kreiser".

Signed and Sealed this

Sixth Day of November, 2001

*Attest:*

Nicholas P. Godici

NICHOLAS P. GODICI
*Acting Director of the United States Patent and Trademark Office*

*Attesting Officer*